US008070268B2

(12) United States Patent
Okazawa et al.

(10) Patent No.: US 8,070,268 B2
(45) Date of Patent: Dec. 6, 2011

(54) LIQUID EJECTING HEAD AND LIQUID EJECTING APPARATUS

(75) Inventors: Noriaki Okazawa, Shiojiri (JP); Fujio Akahane, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 955 days.

(21) Appl. No.: 12/036,865

(22) Filed: Feb. 25, 2008

(65) Prior Publication Data

US 2008/0204512 A1 Aug. 28, 2008

(30) Foreign Application Priority Data

Feb. 26, 2007 (JP) ..... 2007-046101

(51) Int. Cl.
*B41J 2/135* (2006.01)
*B41J 2/045* (2006.01)
*B41J 2/17* (2006.01)

(52) U.S. Cl. ..... 347/68; 347/47; 347/54; 347/84

(58) Field of Classification Search ..... 347/27, 347/44, 47, 54, 68, 70, 84–87
See application file for complete search history.

(56) References Cited

U.S. PATENT DOCUMENTS 6,968,723 B2 * 11/2005 Akahane et al. ..... 72/334
6,997,027 B2 * 2/2006 Akahane et al. ..... 72/325
7,052,119 B2 * 5/2006 Akahane et al. ..... 347/71
7,070,263 B2 * 7/2006 Okazawa ..... 347/68
7,127,929 B2 * 10/2006 Akahane et al. ..... 72/334
7,165,433 B2 * 1/2007 Akahane et al. ..... 72/335
7,194,886 B2 * 3/2007 Akahane et al. ..... 72/334
7,229,162 B2 * 6/2007 Okazawa ..... 347/84
7,575,305 B2 * 8/2009 Akahane et al. ..... 347/68
7,771,012 B2 * 8/2010 Hosono et al. ..... 347/40
7,841,705 B2 * 11/2010 Takahashi ..... 347/68
7,905,431 B2 * 3/2011 Akahane et al. ..... 239/522
7,984,982 B2 * 7/2011 Okazawa ..... 347/94

FOREIGN PATENT DOCUMENTS

JP 2000-006397 1/2000
JP 2005-153369 6/2005

* cited by examiner

*Primary Examiner* — Kevin S Wood
(74) *Attorney, Agent, or Firm* — Workman Nydegger

(57) ABSTRACT

A liquid ejecting head includes: a flow channel unit including a flow-channel-formed substrate that defines liquid flow channels including pressure chambers communicating with nozzle openings and a sealing plate formed with a diaphragm that varies the capacities of the pressure chambers and a liquid introduction hole, the sealing plate being joined to the flow-channel-formed substrate and defining lines of liquid flow channels including pressure chambers; and a head case including a storage chamber that accommodates a pressure generator for displacing the diaphragm and a case flow channel for supplying liquid to the liquid flow channel of the flow channel unit, the diaphragm being arranged at an opening of the storage chamber on the bottom surface side and the flow channel unit being joined to the head case in a state in which the case flow channel and the liquid flow channel are communicated with each other via the liquid introduction hole, and the sealing plate is formed of a composite plate member formed by adhering an electrically conductive supporting substrate which is joined to the head case and an insulative elastic film joined to the flow-channel-formed substrate to each other, the inner diameter of the liquid introduction hole at least on the side of the supporting substrate is set to be larger than the inner diameter of the case flow channel to form a shoulder portion between the case flow channel and the liquid introduction hole, and an insulating material is secured in the shoulder portion.

6 Claims, 5 Drawing Sheets

LIQUID EJECTING HEAD AND LIQUID EJECTING APPARATUS

The entire disclosure of Japanese Patent Application No. 2007-46101, filed Feb. 26, 2007 is expressly incorporated by reference herein.

BACKGROUND

1. Technical Field

The present invention relates to an liquid ejecting head such as an ink jet recording head and a liquid ejecting apparatus and, more specifically, to a liquid ejecting head including a flow channel unit which defines lines of liquid flow channels extending from a common liquid chamber through pressure chambers to nozzle openings and being capable of discharging liquid from the nozzle openings as liquid drops by driving a pressure generator and a liquid ejecting apparatus having the same.

2. Related Art

Examples of a liquid ejecting head that generates pressure variations in liquid in a pressure chambers to cause the liquid to be discharged from nozzle openings as liquid drops include inkjet recording heads used for image recording apparatuses such as printers, color material ejecting heads used for manufacturing color filters for liquid crystal displays or the like, electrode material ejecting head used for forming electrodes such as Organic EL (Electro Luminescence) display and FEDs (Field Emission Displays), and biomedical organic substance ejecting heads used for manufacturing biochips.

The recording head, which is a sort of liquid ejecting head, includes lines of liquid flow channels extending from a common ink chamber (common liquid chamber/reservoir) through pressure chambers to the nozzles, generates pressure variations in liquid in the pressure chambers by activating a pressure generator such as a piezoelectric vibrator, and causes ink in the pressure chambers to be discharged from the nozzles as ink drops using the pressure variations. Some of the recording heads of the type described above include an actuator unit (vibrator unit) formed by joining a group of piezoelectric vibrators on a fixed plate and a flow channel unit formed with the ink channels fixed to a head case.

The flow channel unit includes, for example, a nozzle plate of a metal plate type formed with a plurality of nozzle openings in line, a flow-channel-formed substrate formed with flow channel bodies which serve as ink flow channels such as pressure chambers and a sealing plate (vibrating plate) that seals the openings of the flow channel bodies on the flow-channel-formed substrate, and is manufactured by integrally laminating these members. The sealing plate is formed of composite plate material, which is manufactured by laminating a resin elastic film on a metallic supporting panel such as stainless steel and removing part of the supporting plate, and is adapted to be joined to the flow-channel-formed substrate on the side of the surface with the elastic film. A diaphragm which changes the capacities of the pressure chambers is provided on the sealing plate at a portion corresponding to the pressure chambers. The diaphragm is manufactured by removing the supporting panel around and except for island portions where the distal end surfaces of the piezoelectric vibrators are joined to by etching or the like and keeping only the elastic film remained. A portion of the sealing panel corresponding to the common ink chamber is formed with ink introducing holes (liquid introducing holes) for introducing ink from a case flow channel in the head case into the common ink chamber as a part of the ink flow channels so as to penetrate through the supporting plate and the elastic film.

The head case is a member formed into a hollow block shape with, for example, synthetic resin. The head case is formed with a storage chamber which is able to accommodate an actuator unit. The storage chamber is formed so as to extend from the bottom surface of the head case, which corresponds to a surface to which the flow channel unit is joined, continuously to the upper surface opposite from the bottom surface. In other words, the storage chamber is formed as a through opening which penetrates through the head case in the direction of the height. Provided in the interior of the head case is the case flow channel penetrated through the direction of the height thereof. The upper end of the case flow channel communicates with the ink introduction channel of an introduction needle unit provided with an ink introduction needle, and the lower end of the case flow channel communicates with the ink flow channel in the flow channel unit through the ink introduction hole on the sealing plate. Therefore, the ink introduced from the ink introduction needle is supplied to the ink flow channel through the case flow channel and the ink introduction hole.

The flow channel unit is joined to the bottom surface of the head case configured as described above. More specifically, the diaphragm of the sealing plate is arranged in the opening of the storage chamber on the side of the bottom surface and the sealing plate is joined to the bottom surface of the head case by bonding or the like in a state in which the case flow channel and the ink flow channels are communicated with each other in a liquid-tight manner via the ink introducing hole, so that the flow channel unit is fixed to the head case. The actuator unit is inserted from the opening of the storage chamber on the side of the upper surface in a posture in which free ends of the piezoelectric vibrators are positioned on the distal side, and is stored in the storage chamber in a state in which the distal ends of the free ends abut against the surfaces of the island portions. Then, the distal ends of the free ends of the piezoelectric vibrators are joined to the island portions, and the fixed plate (fixed substrate) is bonded to the inner wall surface of the storage chamber so that the actuator unit is fixed in the storage chamber. JP-A-2000-006397 is an example of related art.

In the configuration described above, since the island portions of the diaphragm are electrically independent from the rest of the supporting plate, normally, there is no possibility that an electrical current flows from the island portions to the rest even when drive signals are applied to the piezoelectric vibrators. However, since the diaphragm is exposed into the storage chamber through the opening on the bottom surface of the head case, there is a case in which foreign substances such as machining chips enter into the storage chamber during the recording head assembly process, and drop onto the diaphragm. When the substances are metal or the like having electric conductivity, short-circuit between the diaphragm (that is, the island portions) and the rest of the supporting plate may occur. When such short circuit occurs, the entire supporting plate has the same potential as individual electrodes formed on the distal end surface of the piezoelectric vibrator (positive potential). On the other hand, the nozzle plate arranged on the opposite side of the supporting plate with the intermediary of the flow-channel-formed substrate is adjusted to a ground potential for preventing electrostatic charge. Accordingly, the inner peripheral surface of an ink introducing hole which is a portion of the supporting plate coming into contact with ink and the periphery of the nozzle opening of the nozzle plate serve as if they are electrodes, and hence the ink therebetween may be electrolyzed. When such electrolysis proceeds, the components in ink such as pigment is precipitated around the ink introducing hole and sludge may clog the flow channels or the nozzle openings and cause defective discharge.

SUMMARY

An advantage of some aspects of the invention is to provide a liquid ejecting head and a liquid injection apparatus which are able to prevent electrolysis of liquid caused by attachment of electrically conductive substances.

According to an aspect of the invention, a liquid ejecting head includes: a flow channel unit including a flow-channel-formed substrate that defines liquid flow channels including pressure chambers communicating with nozzle openings and a sealing plate formed with a diaphragm that varies the capacities of the pressure chambers and a liquid introduction hole, the sealing plate being joined to the flow-channel-formed substrate and defining lines of liquid flow channels including pressure chambers; and a head case including a storage chamber that accommodates a pressure generator for displacing the diaphragm and a case flow channel for supplying liquid to the liquid flow channel of the flow channel unit, the diaphragm being arranged at an opening of the storage chamber on the bottom surface side and the flow channel unit being joined to the head case in a state in which the case flow channel and the liquid flow channel are communicated with each other via the liquid introduction hole in which the sealing plate is formed of a composite plate member formed by adhering an electrically conductive supporting substrate which is joined to the head case and an insulative elastic film joined to the flow-channel-formed substrate to each other, in which the inner diameter of the liquid introduction hole at least on the side of the supporting substrate is set to be larger than the inner diameter of the case flow channel to form a shoulder portion between the case flow channel and the liquid introduction hole, and in which an insulating material is secured in the shoulder portion.

In this configuration, since the inner diameter of the liquid introduction hole at least on the side of the supporting substrate is set to be larger than the inner diameter of the case flow channel to form the shoulder portion between the case flow channel and the liquid introduction hole, and the insulating material is secured in the shoulder portion, the liquid flowing through the liquid introduction hole is prevented from coming into contact with the supporting substrate by the insulating material. Accordingly, in a case in which the diaphragm and the supporting substrate therearound are electrically short-circuited by foreign substances having electrical conductivity, occurrence of electrolysis of liquid between the liquid introduction hole of the supporting substrate and the periphery of the nozzle openings of a nozzle-formed plate is prevented. Consequently, problems such as defective discharge due to precipitation of components included in the liquid by electrolysis are prevented.

Preferably, the inner peripheral surface of the liquid introduction hole of the supporting substrate is covered and hidden by the insulating material.

Preferably, the insulating material is an adhesive agent that joins the head case and the flow channel unit.

Preferably, the adhesive agent is epoxy-based adhesive agent.

In this configuration, since the adhesive agent for joining the head case and the flow channel unit is used as the insulating material, it is not necessary to prepare additional insulating material and hence manufacture of the recording head is simplified.

Preferably, the diameter of the liquid introduction hole is increased from the side of the joint surface with respect to the flow-channel-formed substrate toward the side of the joint surface with respect to the head case.

The liquid ejecting apparatus according to an aspect of the invention includes the liquid ejecting head having configurations as described above.

In this configuration, since the liquid ejecting which is able to prevent defective discharge due to the electrolysis of liquid is mounted, a reliable liquid ejecting apparatus is provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
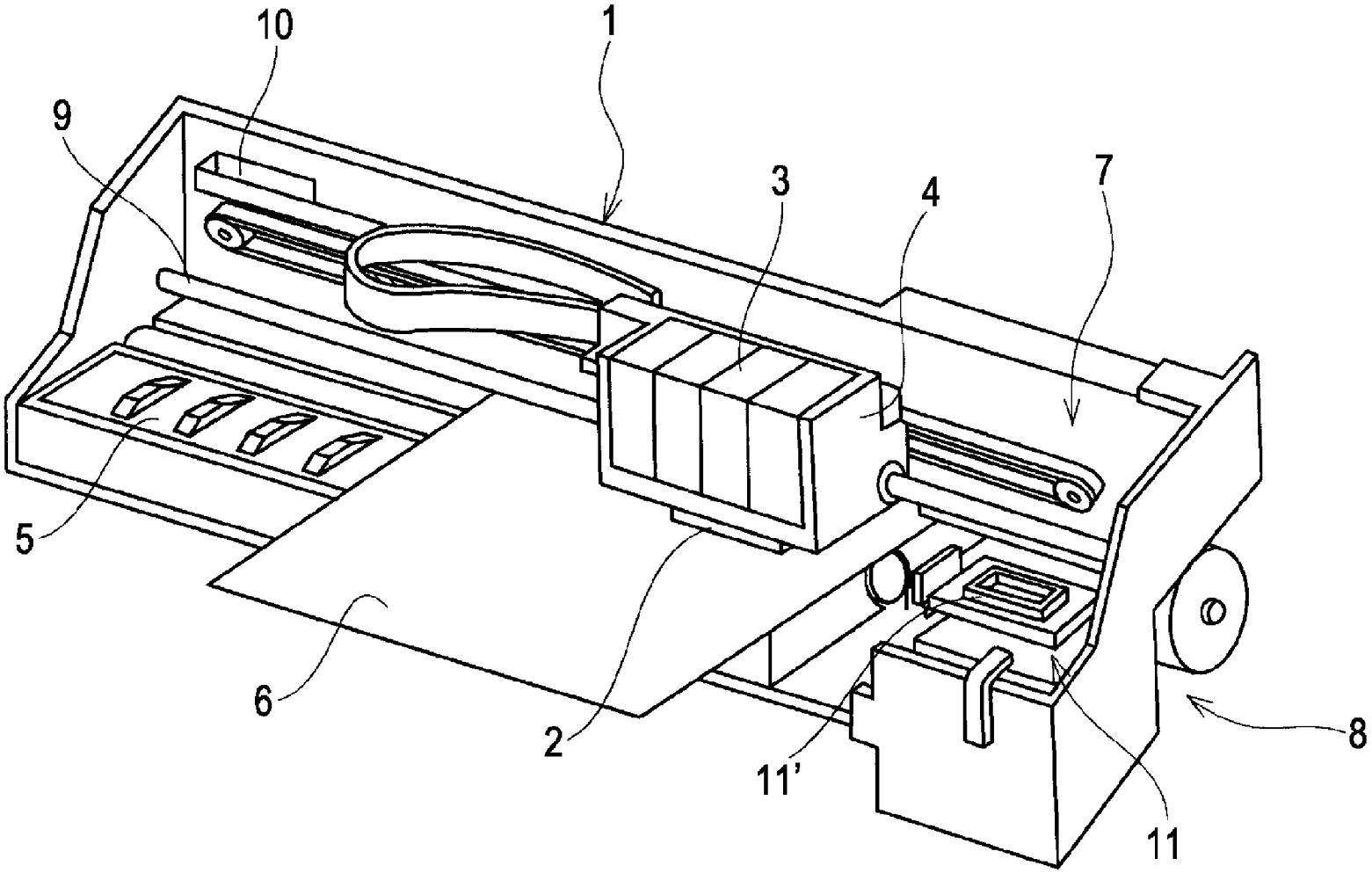
FIG. 1 is an explanatory perspective view illustrating a configuration of a printer.

Referring now to the attached drawings, exemplary embodiments of the invention will be described below. In the embodiments shown below, although various limitations are given as an preferred embodiment of the invention, the scope of the invention is not limited to these embodiments unless otherwise specified. In the description shown below, an inkjet printer (hereinafter, referred to as printer) shown in FIG. 1 is exemplified as the liquid ejecting apparatus of the invention.

A printer 1 roughly includes a carriage 4 that has a recording head 2 as a sort of liquid ejection head mounted thereon and an ink cartridge 3 as a sort of liquid storage member detachably mounted thereon, a platen 5 disposed below the recording head 2 for transporting recording paper 6 (a sort of discharged object), a carriage transfer mechanism 7 that transfers the carriage 4 in the paper width direction of the recording paper 6. The term "paper width direction" in this case means the primary scanning direction (head scanning direction) and the term "paper feed direction" means the secondary scanning direction (a direction orthogonal to the head scanning direction). The ink cartridge 3 is not limited to a type which is mounted to the carriage 4 as in this embodiment, and a type which is mounted to a housing of the printer 1 and supplies ink to the recording head 2 via an ink supply tube (so-called off-carriage type) may also be applied.

The carriage 4 is mounted in a state of being rotatably supported by a guide rod 9 laid across the printer in the primary scanning direction, and is configured to move along the guide rod 9 in the primary scanning direction by the movement of the carriage transfer mechanism 7. The position of the carriage 4 in the primary scanning direction is detected by a linear encoder 10, and a detection signal is sent to a controller (not shown). Accordingly, the controller is able to control a recording operation (discharging operation) of the recording head 2 while recognizing the scanning position of the recording head 2 on the basis of positional information from the linear encoder 10.

A home position, which is a starting point of the scanning operation of the recording head 2, is set within the range of movement of the recording head 2 and outside the platen 5. A capping mechanism 11 is provided at the home position. The capping mechanism 11 serves to seal a nozzle-formed surface of the recording head 2 with a cap member 11' to prevent ink solvent from evaporating from nozzle openings 37 (see FIG. 2). The capping mechanism 11 is also used for a cleaning operation which provides a negative pressure to the sealed nozzle surface to forcedly suck and discharge the ink from the nozzle openings 37.

Figure 2:
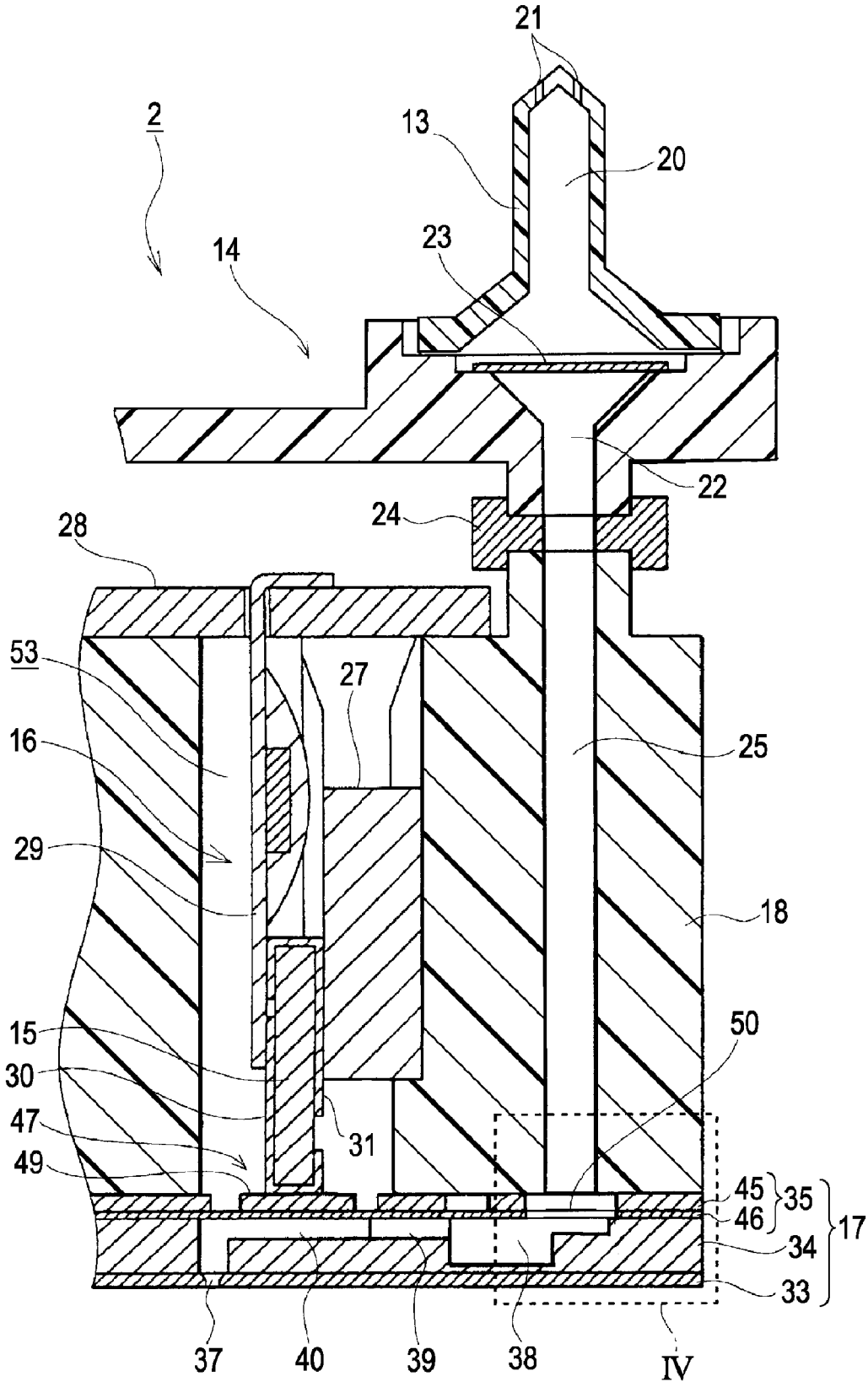
FIG. 2 is an explanatory cross-sectional view of a principal portion of a configuration of a recording head.
Figure 3:
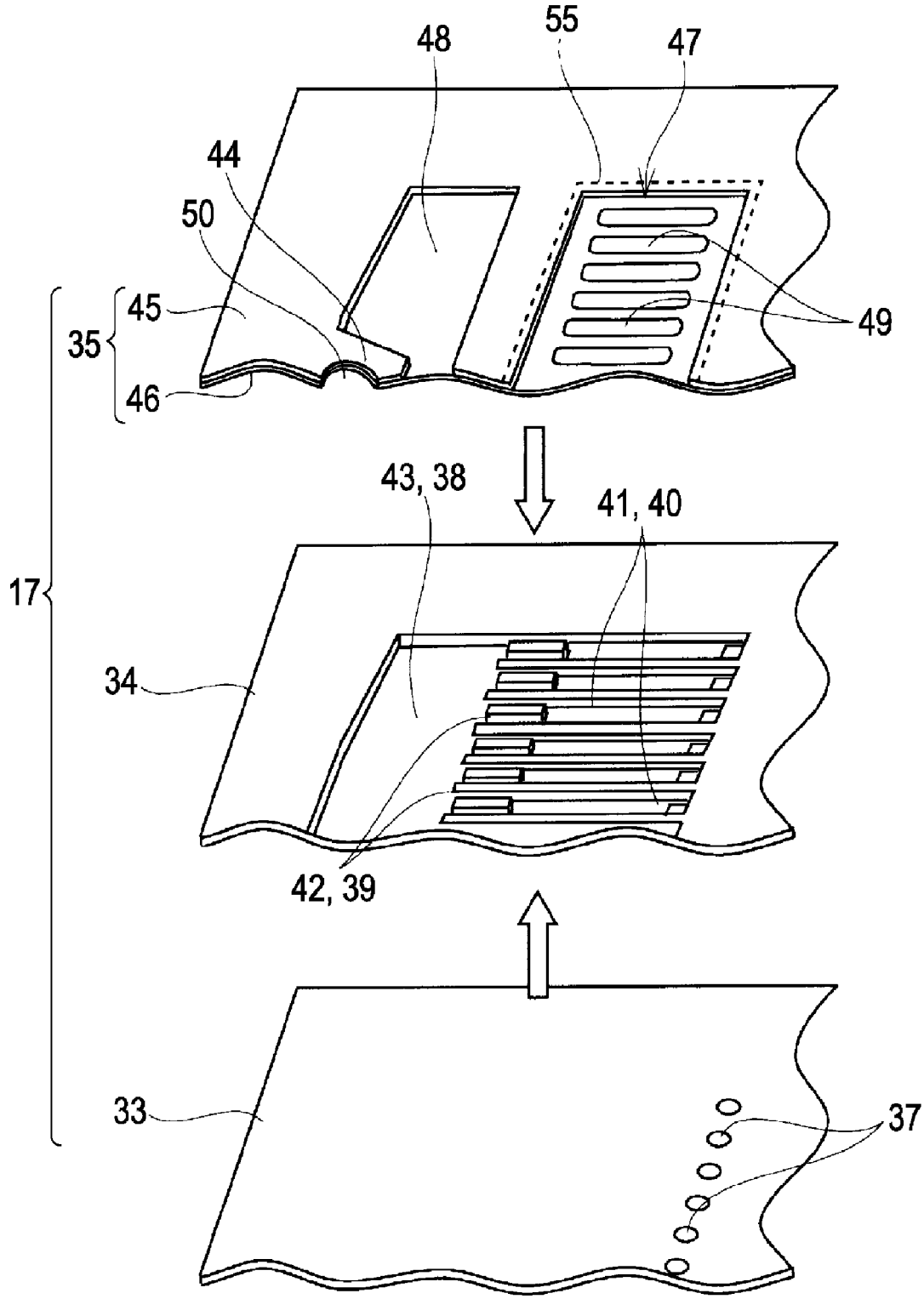
FIG. 3 is an explanatory exploded perspective view illustrating a configuration of a flow channel unit.
Figure 4:
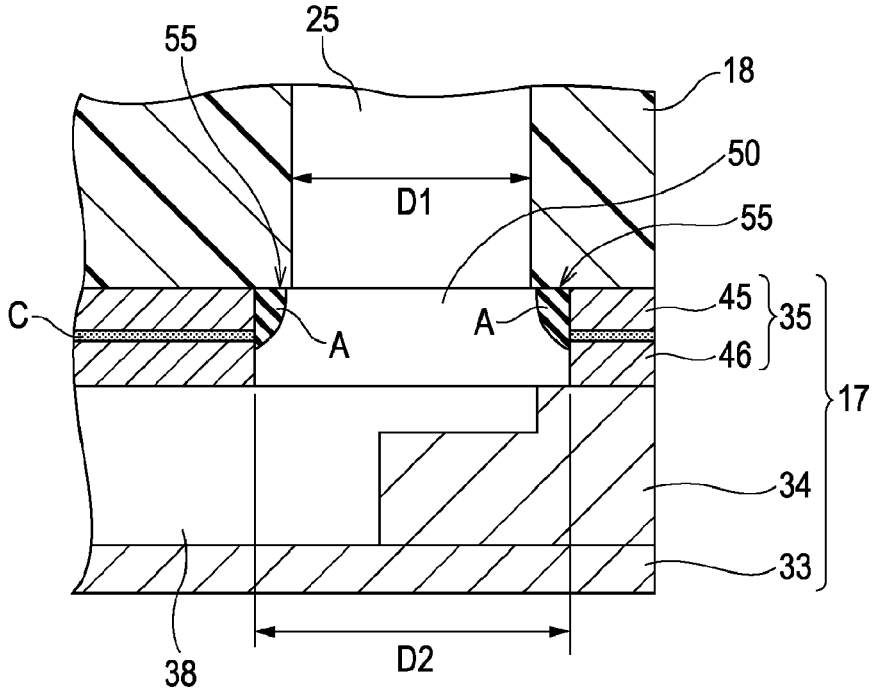
FIG. 4 is an enlarged cross-sectional view of an area X in FIG. 2.

FIG. 2 is a cross-sectional view showing a principal portion of the recording head 2 for explaining the configuration of the same; FIG. 3 is an exploded perspective view for explaining the configuration of the flow channel unit; and FIG. 4 is an enlarged cross-sectional view showing an area X in FIG. 2. The recording head 2 shown as an example roughly includes an introduction needle unit 14 having an ink introduction needle 13 provided upright, a vibrator unit 16 having a plurality of piezoelectric vibrators 15, a flow channel unit 17 defining flow channels (a sort of liquid flow channel), a head case 18 to which the vibrator unit 16 and the flow channel unit 17 are fixed, and a wiring board 28 that supplies drive signals to the piezoelectric vibrators 15.

The ink introduction needle 13 (a sort of liquid introduction needle) is a hollow needle-shaped member molded with synthetic resin, and the internal space thereof serves as a needle flow channel 20 in which ink (a sort of liquid in the invention) in the liquid storage member such as an ink cartridge or a sub tank, not shown, is introduced. The extremity of the ink introduction needle 13 is formed with an introduction hole 21 which communicates with the needle flow channel 20, and the ink in the liquid storage member is introduced into the needle flow channel 20 through the introduction hole 21 when the ink introduction needle 13 is inserted into the interior of the liquid storage member.

The introduction needle unit 14 is molded with synthetic resin like the ink introduction needle 13, and is formed with an ink introduction channel 22 corresponding to the ink introduction needle 13 formed therein. The upstream end of the ink introduction channel 22 is increased in diameter in a funnel shape toward the side where the introduction needle is attached, and a filter 23 that filters the foreign substances in the ink is provided at the opening thereof. The ink introduction needle 13 is fixed to the introduction needle unit 14 by welding or the like in a state in which the position of the downstream opening of the needle flow channel 20 is aligned to the position of the upstream opening of the ink introduction channel 22. Accordingly, the ink introduction channel 22 of the introduction needle unit 14 and the needle flow channel 20 of the ink introduction needle 13 are communicated with each other via the filter 23 in a liquid-tight manner.

The vibrator unit 16 includes the piezoelectric vibrators 15 as pressure generator, a fixed plate 27 to which the piezoelectric vibrators 15 are joined, and flexible cables 29 that supply the drive signal to the piezoelectric vibrators 15 from the wiring board 28. The piezoelectric vibrators 15 in this embodiment are laminated piezoelectric vibrators formed by laminating piezoelectric substances sandwiched between electrodes and cut into an elongated comb shape. The piezoelectric vibrators 15 are configured as vertically vibrating piezoelectric vibrators expandable in the vertical direction (longitudinally of the vibrators). The respective piezoelectric vibrators 15 are joined to the fixed plate 27 at the fixed ends thereof in such a manner that the free ends are protruded from the distal edge of the fixed plate 27, that is, so-called a cantilevered state. The distal end surfaces of the free ends of the piezoelectric vibrators 15 are joined to island portions 49 of a diaphragm 47 formed on a sealing plate 35.

Individual external electrodes 30 and a common external electrode 31 are formed on the surfaces of the piezoelectric vibrators 15. The individual external electrodes are electrodes which are formed continuously from the distal end surface of the piezoelectric vibrators to a wiring connected surface (a surface to which the flexible cable 29 is connected), which are side surfaces of the piezoelectric vibrators 15 in the direction of lamination, and are in electrical conduction with individual internal electrodes (not shown) in the interior of the piezoelectric vibrators 15. The individual external electrodes 30, which are one of the external electrodes, are electrically connected to individual terminals of the flexible cables 29, and the common electrode 31, which is the other one of the external electrodes, is electrically connected to a common terminal (ground terminal) of the flexible cables 29. When a drive signal is applied to the piezoelectric vibrators 15 through the flexible cables 29, the piezoelectric substances are deformed by the potential difference between the individual external electrodes (individual internal electrodes) and the common external electrode 31 (common internal electrode). Accordingly, the piezoelectric vibrators 15 are driven to expansion and contraction.

As shown in FIG. 3, the flow channel unit 17 includes a nozzle plate 33, a flow-channel-formed substrate 34 and a sealing plate 35 (vibrating panel), and is configured by arranging the nozzle plate 33 on one of the surfaces of the flow-channel-formed substrate 34 and arranging the sealing plate 35 on the other surface of the flow-channel-formed substrate 34 which is the opposite side from the nozzle plate 33 and integrating with adhesion or the like. The nozzle plate 33 which is located to the lowermost position in the flow channel unit 17 is a thin stainless steel plate member formed with a plurality of nozzle openings 37 in row. Ion this embodiment, for example, 180 nozzle openings 37 are formed at pitches corresponding to 180 dpi, so that the nozzle opening 37 constitutes nozzle rows. The nozzle plate 33 is adjusted to a ground potential through a metallic cover, not shown, for preventing electrostatic charge or noise generated by the recording paper or the like.

The flow-channel-formed substrate 34 is a plate-shaped member formed with flow channel bodies, which correspond to a line of ink flow channels (a sort of liquid flow channels) having pressure chambers 40 divided into compartments. More specifically, pressure chamber void portions 41 as the pressure chambers 40, grooves 42 which corresponds to ink supply ports 39 and a void portion 43 which corresponds to a common ink chamber 38 are formed on the flow-channel-formed substrate 34 by etching process. The flow-channel-formed substrate may be formed by laminating a plurality of plate members.

The pressure chambers 40 are formed into elongated chambers extending in the direction orthogonal to the direction of rows of the nozzle openings 37 (the direction of nozzle rows), and the ink supply ports 39 are formed as portions having a narrow flow channel width (orifice) which communicates the pressure chamber 40 and the common ink chamber 38. The common ink chamber 38 is a chamber in which ink introduced from the ink introduction needle 13 and supplied through the ink introduction channel 22 and a case flow channel 25 is stored temporarily. The ink stored in the common ink chamber 38 is distributed to the respective pressure chambers 40 through the ink supply ports 39.

The sealing plate 35 is a double-structure composite plate member formed by laminating an elastic film 46 formed of an insulative flexible film such as PPS (polyphenylene sulfide) or the like on a supporting substrate 45 formed of a electrically conductive plate member such as stainless steel with the intermediary of adhesive layer C (for example, an urethane based adhesive agent, see FIG. 4), and is adapted to be joined to the flow-channel-formed substrate 34 on the side of the elastic film 46 and to the bottom surface of the head case 18 on the side of the supporting substrate 45, respectively. The sealing plate 35 is a member formed with a diaphragm 47 that seals the opening surfaces on one side of the pressure chambers 40 (pressure chamber void portions 41) and varies the capacities of the pressure chambers 40, and is formed with a compliance portion 48 that seals one of the opening surfaces of the common ink chamber 38 (void 43). The diaphragm 47 is manufactured by removing the supporting substrate 45 around and except for portions where the distal end surfaces of the piezoelectric vibrators 15 as the insular portions 49 are joined to by etching and keeping only the elastic film 46 remained. In other words, the insular portions 49 are independent from the rest of the supporting substrate 45. The shape of each of the insular portions 49 is a block shape elongated in the direction orthogonal to the direction of the row of the nozzle openings 37.

The portion of the sealing plate 35 which functions as the compliance portion 48, that is, the portion corresponding to the common ink chamber 38 formed by removing the supporting substrate 45 substantially along the shape of the opening of the void 43 of the flow-channel-formed substrate 34, and only the elastic film 46 remains. When forming the compliance portion 48, etching is carried out so as to leave part of the supporting substrate 45 of the sealing plate 35 as an apron 44 protruding from the edge of the compliance portion 48 toward the center (FIG. 3). The apron 44 is formed with an ink introduction hole 50 (which correspond to a liquid introduction hole in the invention) in a state of penetrating through the supporting substrate 45 and the elastic film 46. The ink introduction hole 50 is a through hole for introducing ink flowing down from the case flow channel 25 of the head case 18 toward the common ink chamber 38, and in this embodiment, is formed into a circular shape. The size (inner diameter) of the ink introduction hole 50 is set to be larger than the inner diameter of the case flow channel 25.

The head case 18 is a hollow block shaped member formed of synthetic resin and is formed with a storage chamber 53 which is able to accommodate the vibrator unit 16, and the case flow channel 25 that supplies ink from the introduction needle unit 14 toward the flow channel unit 17. The storage chamber 53 of the head case 18 is formed from the bottom surface of the head case 18 which serves as a surface to mount the flow channel unit continuously to the upper surface to which the introduction needle unit 14 and the wiring board 28 are mounted. In other words, the storage chamber 53 is formed as a through opening which penetrates through the direction of the height of the head case 18.

First of all, the flow channel unit 17 is joined to the head case 18. More specifically, the diaphragm 47 of the sealing plate 35 is arranged in the opening on the bottom surface of the storage chamber 53, and the surface of the sealing plate 35 on the side of the supporting substrate 45 is bonded to the bottom surface of the head case 18 with an adhesive agent (described later) in a state in which the case flow channel 25 and the common ink chamber 38 (that is, the ink flow channel) communicate with each other in a liquid-tight manner via the ink introduction hole 50, so that the flow channel unit 17 is joined to the head case 18. Accordingly, The diaphragm 47 (insular portions 49) is exposed to the opening on the bottom surface of the storage chamber 53 of the head case 18. Subsequently, the vibrator unit 16 is stored in the storage chamber 53 of the head case 18. In other words, the vibrator unit 16 is inserted from the opening on the upper surface side of the storage chamber 53 in a posture in which the free ends of the piezoelectric vibrators 15 positioned on the distal side, and is stored in the storage chamber 53 in a state in which the distal ends of the free ends abut against the surfaces of the insular portions 49. Then, the distal ends of the free end of the piezoelectric vibrators 15 are joined to the insular portions 49 and the fixed plate 27 is bonded to the inner wall surface of the storage chamber 53, so that the vibrator unit 16 is fixed in the storage chamber 53.

After having mounted the flow channel unit 17 and the vibrator unit 16 to the head case 18, the wiring board 28 is disposed on the upper surface of the head case 18, and the wiring of the wiring board 28 and the flexible cable 29 is achieved. Then, the introduction needle unit 14 is attached to the upper surface of the head case 18 with the intermediary of a packing 24. Accordingly, the ink introduction channel 22 of the introduction needle unit 14 communicates with the case flow channel 25 of the head case 18 in a liquid tight manner with the intermediary of the packing 24. Therefore, the ink introduced from the introduction hole 21 of the ink introduction needle 13 passes through the ink introduction channel 22 and the case flow channel 25 and is supplied to the ink flow channel of the flow channel unit 17, that is, the common ink chamber 38 from the ink introduction hole 50.

Then, in the recording head 2 having the configuration as described above, when a drive signal is applied to the piezoelectric vibrators 15 from the wiring board 28 through the flexible cable 29, the piezoelectric vibrators 15 expands and contract longitudinally of the element, whereby the insular portions 49 move toward or away from the pressure chambers 40. Accordingly, the capacities of the pressure chambers 40 vary and pressure variations against the ink occur in the pressure chambers 40. With such pressure variations, the ink drops (a sort of liquid drops) are discharged from the nozzle openings 37.

With regard to the sealing plate 35, the insular portions 49 as part of the supporting substrate 45 having an electrical conductivity are joined to the individual external electrodes 30 formed on the distal end surface of the free end of the piezoelectric vibrators 15, and hence have the same potential as the individual external electrodes 30. On the other hand, the nozzle plate 33 arranged on the opposite side of the sealing plate 35 with the intermediary of the flow-channel-formed substrate 34 is adjusted to the ground potential as described above. Since the insular portions 49 are electrically independent from the rest of the supporting substrate 45, even when the drive signal is applied to the piezoelectric vibrators 15, a flow current does not flow from the insular portions 49 to the rest of the supporting substrate 45 in a normal state.

However, as described above, since the diaphragm 47 is disposed into the opening on the bottom surface of the storage chamber 53 of the head case 18, foreign substances such as machining chips enter into the storage chamber 53 of the head case 18, and may drop onto the exposed portion in including the diaphragm 47 and the periphery thereof, for example, during the recording head 2 assembly process. When the substances are metal or the like having electric conductivity and are attached across a portion between the insular portions 49 and the rest of the supporting substrate 45, short-circuit may occur therebetween. When such short-circuit occurs, the substantially entire portion of the supporting substrate 45 is brought to have the same potential as the distal end surfaces of the piezoelectric vibrators 15 (that is, the individual external electrodes 30) (positive potential).

Accordingly, in the related art, the inner peripheral surface of the ink introducing hole which is a portion of the supporting plate of the sealing plate coming into contact with ink and the periphery of the nozzle openings of the nozzle plate serve as if they are electrodes, and hence the ink therebetween may be electrolyzed. When such electrolysis proceeds, the components in ink such as pigment is precipitated around the ink introducing hole, and sludge may clog the flow channels or the nozzle openings and cause defective discharge.

In view of such circumstances, The recording head 2 according to an aspect of the invention, at least an inner diameter D2 of the ink introduction hole 50 is set to be larger than an inner diameter D1 of the case flow channel 25 as shown in FIG. 4 (in other words, the inner diameter D1 of the case flow channel 25 is set to be smaller than the inner diameter D1 of the ink introduction hole 50 of the supporting substrate 45), so that the periphery of the opening of the case flow channel 25 is overhung from the ink introduction hole 50 to form a shoulder portion 55 between the case flow channel 25 and the ink introduction hole 50, and an insulating material A is disposed and secured at the shoulder portion 55. The insulating material A covers and hides the inner peripheral surface of the ink introducing hole of the supporting substrate 45. The insulating material A may be of any type as long as it has an electrically insulating property and is secured in the shoulder portion 55, and in this embodiment, an adhesive agent for joining the head case 18 and the flow channel unit 17 is used. The adhesive agent preferably has an ink-resistant property (chemical-resistant property) and, for example, preferably is epoxy-based adhesive agent.

When joining the head case 18 and the flow channel unit 17, a sheet-type adhesive agent is transferred to the joint surface of the flow channel unit of the head case 18, and the surface of the flow channel unit 17 on the side of the sealing plate 35 is bonded to the transferred portion. In this case, since there is formed the shoulder portion 55 between the case flow channel 25 and the ink introduction hole 50 as described above, part of the adhesive agent flows into the shoulder portion 55 (toward the ink introduction hole 50) as shown in FIG. 4, and the flowed adhesive agent A is solidified in a state in which the part of the adhesive agent covers the inner peripheral surface of the linear encoder 10 and serves as the insulating material A described above.

In this manner, by forming the shoulder portion 55 between the case flow channel 25 and the ink introduction hole 50, and introducing and securing the insulating material to the shoulder portion 55, the ink flowing thorough the ink introduction hole 50 does not come into contact with the supporting substrate 45, and hence the electrolysis of the ink is prevented from occurring even when the individual external electrodes 30 of the piezoelectric vibrators 15 and the entire supporting substrate 45 are short-circuited. Consequently, defective discharge caused by the electrolysis of the ink may be restrained. In a case in which a viscous layer C interposed between the supporting substrate 45 and the elastic film 46 is a material easily corroded by ink as well, corrosion by the ink is prevented by covering the viscous layer C with an insulating material, so that the adhesion between the supporting substrate 45 and the elastic film 46 is ensured. Since the printer 1 has the recording head 2 configured as described above mounted thereto, a reliable discharge control is achieved. In this embodiment, since the adhesive agent for joining the head case 18 and the flow channel unit 17 is used as the insulating material, it is not necessary to prepare additional insulating material and hence manufacture of the recording head 2 is simplified.

The invention is not limited to the embodiment shown above, and various modifications may be made without departing the scope of the claims.

Figure 5:
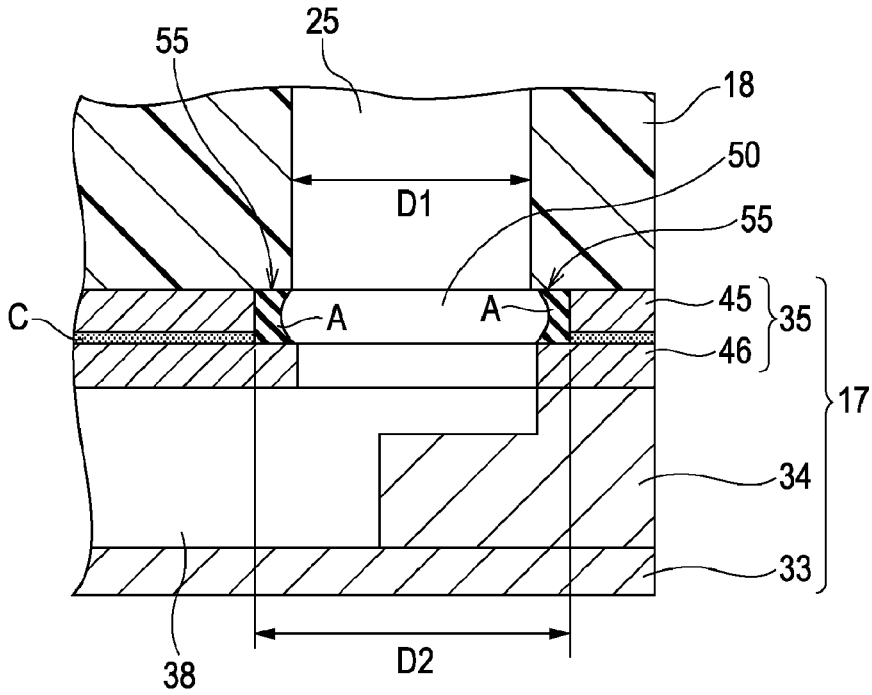
FIG. 5 is an explanatory cross-sectional view illustrating a principal portion of a configuration in a second embodiment.

FIG. 5 is an explanatory cross-sectional view of a principal portion illustrating a configuration of a second embodiment of the invention. In the second embodiment, only the inner diameter D2 of the ink introduction hole 50 on the side of the supporting substrate 45 is set to be larger than the inner diameter D1 of the case flow channel 25, and the inner diameter thereof on the side of the elastic film 46 is aligned with the inner diameter D1 of the case flow channel 25. In this configuration, part of the head case 18 and part of the elastic film 46 overhung with respect to the hole on the side of the supporting substrate 45 toward the center of the hole diameter. Therefore, the overhung portions help the adhesive agent to be trapped in the shoulder portion 55. Accordingly, the contact of the supporting substrate 45 with respect to the ink is prevented further reliably. What is important is to form the shoulder portion 55 by setting at least the inner diameter D2 on the side of the supporting substrate 45 to be larger than the inner diameter D1 of the case flow channel 25.

Figure 6:
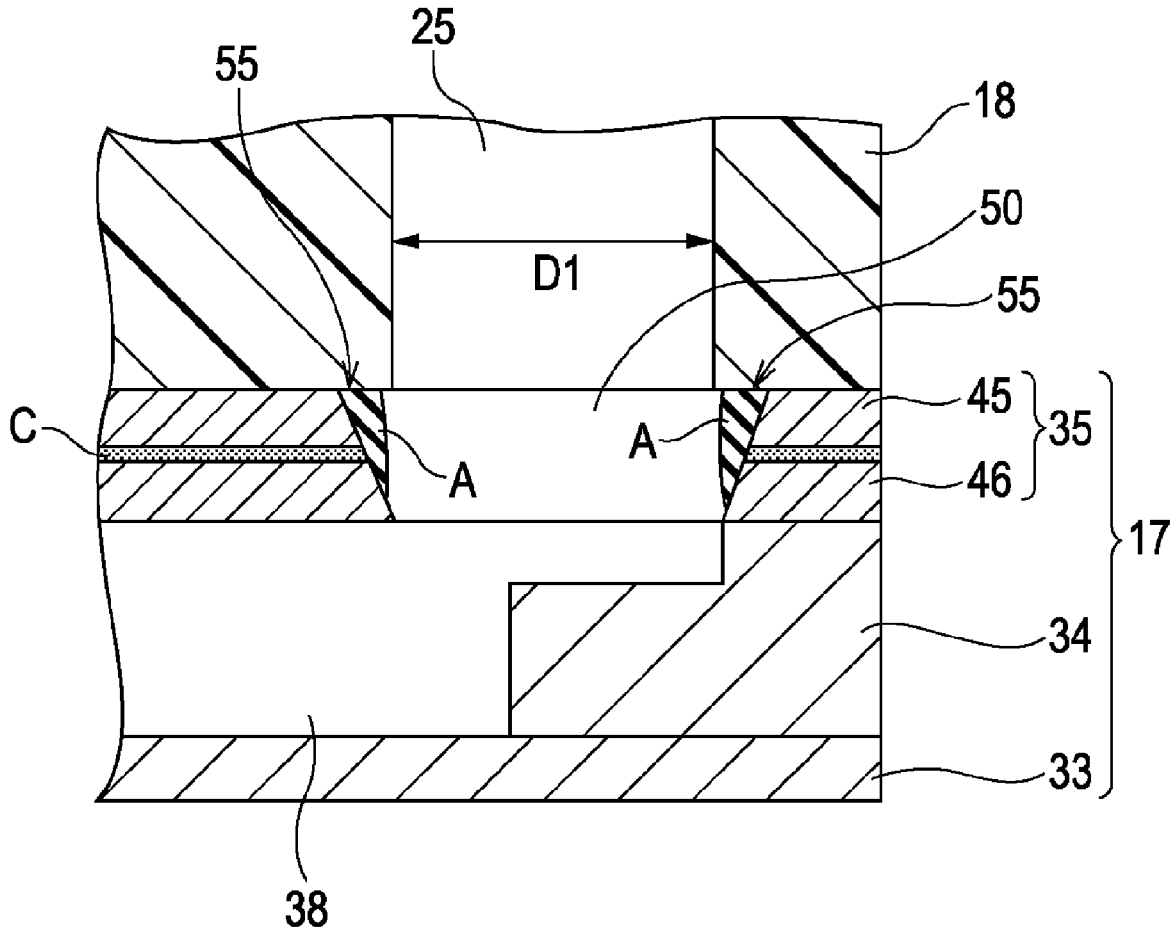
FIG. 6 is an explanatory cross-sectional view illustrating a configuration in a third embodiment.

FIG. 6 is an explanatory cross-sectional view illustrating a configuration of a third embodiment of the present invention. In the third embodiment, the diameter of the ink introduction hole 50 is increased from the side of the joint surface with respect to the flow-channel-formed substrate (lower side in the drawing) toward the side of the joint surface on the side of the head case (upper side in the drawing). In this embodiment, the inner diameter of the opening of the ink introduction hole 50 on the downstream side is aligned to the inner diameter D1 of the case flow channel 25, and the inner diameter of the opening on the upstream side is set to be larger than the inner diameter D1 of the case flow channel 25 to form the shoulder portion 55. In this configuration as well, the same effects and advantages as in the embodiments shown above are achieved.

The invention may also be applied to other types of liquid ejecting heads and liquid ejecting apparatuses as long as the sealing plate having the configuration as described above is provided. For example, the invention may be applied also to display manufacturing apparatuses for manufacturing color filters for the liquid crystal displays, electrode manufacturing apparatuses for forming electrodes for organic EL (Electro Luminescence) displays or FEDs (Field Emission Displays), and chip manufacture apparatuses for manufacturing biochips.

What is claimed is:

1. A liquid ejecting head comprising:

a flow channel unit including a flow-channel-formed substrate that defines liquid flow channels including pressure chambers communicating with nozzle openings and a sealing plate formed with a diaphragm that varies the capacities of the pressure chambers and a liquid introduction hole, the sealing plate being joined to the flow-channel-formed substrate and defining lines of liquid flow channels including pressure chambers; and a head case including a storage chamber that accommodates a pressure generator for displacing the diaphragm and a case flow channel for supplying liquid to the liquid flow channel of the flow channel unit, the diaphragm being arranged at an opening of the storage chamber on the bottom surface side and the flow channel unit being joined to the head case in a state in which the case flow channel and the liquid flow channel are communicated with each other via the liquid introduction hole wherein the sealing plate is formed of a composite plate member formed by adhering an electrically conductive supporting substrate which is joined to the head case and an insulative elastic film joined to the flow-channel-formed substrate to each other, wherein the inner diameter of the liquid introduction hole at least on the side of the supporting substrate is set to be larger than the inner diameter of the case flow channel to form a shoulder portion between the case flow channel and the liquid introduction hole, and wherein an insulating material is secured in the shoulder portion.

2. The liquid ejecting head according to claim 1, the inner peripheral surface of the liquid introduction hole of the supporting substrate is covered and hidden by the insulating material.

3. The liquid ejecting head according to claim 1, wherein the insulating material is an adhesive agent that joins the head case and the flow channel unit.

4. The liquid ejecting head according to claim 3, wherein the adhesive agent is epoxy-based adhesive agent.

5. The liquid ejecting head according to claim 1, wherein the diameter of the liquid introduction hole is increased from the side of the joint surface with respect to the flow-channel-formed substrate toward the side of the joint surface with respect to the head case.

6. A liquid ejecting apparatus comprising the liquid ejecting head according to claim 1.

* * * * *